US005456082A

United States Patent [19]

Keolian et al.

[11] Patent Number: 5,456,082

[45] Date of Patent: Oct. 10, 1995

[54] PIN STACK ARRAY FOR THERMOACOUSTIC ENERGY CONVERSION

[75] Inventors: Robert M. Keolian, Monterey, Calif.; Gregory W. Swift, Santa Fe, N.M.

[73] Assignee: The Regents of the University of California, Alameda, Calif.

[21] Appl. No.: 261,361

[22] Filed: Jun. 16, 1994

[51] Int. Cl.[6] ..... F25B 9/00

[52] U.S. Cl. ..... 62/6; 62/467

[58] Field of Search ..... 62/6, 467, 498

[56] References Cited

U.S. PATENT DOCUMENTS

| | | | |
|---|---|---|---|
| 4,114,380 | 9/1978 | Ceperley | 60/721 |
| 4,398,398 | 8/1983 | Wheatley et al. | 62/467 |
| 4,489,553 | 12/1984 | Wheatley et al. | 60/516 |
| 4,625,517 | 12/1986 | Müller | 62/467 X |
| 4,722,201 | 2/1988 | Hofler et al. | 62/467 |
| 4,858,441 | 8/1989 | Wheatley et al. | 62/6 |
| 4,953,366 | 9/1990 | Swift et al. | 62/467 |
| 5,165,243 | 11/1992 | Bennett | 62/6 |
| 5,174,130 | 12/1992 | Lucas | 62/498 |
| 5,303,555 | 4/1994 | Chrysler et al. | 62/6 |
| 5,339,640 | 8/1994 | Reinke | 62/6 |

OTHER PUBLICATIONS

John C. Wheatley et al., "The Natural Heat Engine," Reprinted from Los Alamos Science, No. 24, pp. 2–33 (Fall 1986).

W. Swift, "Thermoacoustic Engines," 84 J. Acoust. Soc. Am. 1145 (1988).

Nikolaus Rott, "Damped and Thermally Driven Acoustic Oscillations in Wide and Narrow Tubes," 20 Z. Angew Math. Phys. 230 (1969).

Pat Arnott et al., "General Formulation of Thermoacoustics for Stacks Having Arbitrarily Shaped Pore Cross Sections," 90 J. Acoust. Soc. Am 3228 (1991).

W. Swift, "Analysis and Performance of a Large Thermoacoustic Engine," 92 J. Acoust. Soc. Am. 1551 (1992).

*Primary Examiner*—Christopher Kilner
*Attorney, Agent, or Firm*—Ray G. Wilson

[57] ABSTRACT

A thermoacoustic stack for connecting two heat exchangers in a thermoacoustic energy converter provides a convex fluid-solid interface in a plane perpendicular to an axis for acoustic oscillation of fluid between the two heat exchangers. The convex surfaces increase the ratio of the fluid volume in the effective thermoacoustic volume that is displaced from the convex surface to the fluid volume that is adjacent the surface within which viscous energy losses occur. Increasing the volume ratio results in an increase in the ratio of transferred thermal energy to viscous energy losses, with a concomitant increase in operating efficiency of the thermoacoustic converter. The convex surfaces may be easily provided by a pin array having elements arranged parallel to the direction of acoustic oscillations and with effective radial dimensions much smaller than the thicknesses of the viscous energy loss and thermoacoustic energy transfer volumes.

4 Claims, 7 Drawing Sheets

PIN STACK ARRAY FOR THERMOACOUSTIC ENERGY CONVERSION

BACKGROUND OF THE INVENTION

This invention relates to thermoacoustic energy conversion, and, more particularly, to thermal stacks for affecting heat energy transfer in thermoacoustic energy converters. This invention was made under the Department of Defense, U.S. Navy, and with government support under Contract No. W-7405-ENG-36 awarded by the U.S. Department of Energy. The government has certain rights in the invention.

In thermoacoustic energy conversion, sound is converted into a temperature gradient or a temperature gradient is converted into sound. This effect has been used to construct refrigerators, heat pumps, acoustic sources, and other useful devices. See, e.g., J. C. Wheatley, et al., "The Natural Heat Engine," Los Alamos Science (1986), and G. W. Swift, "Thermoacoustic Engines," 84 J. Acoust. Soc. Am. 1185 (1988), incorporated herein by reference, which generally discuss the theory of thermoacoustic energy conversion.

At the heart of thermoacoustic energy conversion devices is a thermoacoustic stack. The stack temporarily stores entropy so that heat will be shuttled between parcels of a working fluid excited by sound. Heat exchangers on either end of the stack exchange heat between the working fluid and the external world. Prior art thermoacoustic stacks are shown in FIG. 1: stacks of sheets 10; a honeycomb-like structure 12 with arrays of approximately square, hexagonal, triangular, or round pores; and rolled sheets 14.

To an approximation, the volume of fluid at about a characteristic length from the stack equal to the thermal penetration depth, $\delta_K=\sqrt{2K/\rho_m c_p \omega}$, participates in the thermoacoustic effect, where K is the thermal conductivity of the fluid, $\rho_m$ is the mean density of the fluid, $c_p$ is the specific heat of the fluid, and $\omega$ is the angular frequency of the sound. However, the acoustic oscillations of the working fluid also result in viscous shear stresses that lead to an undesirable energy loss mechanism that occurs in the volume of fluid generally within a viscous penetration depth, $\delta_v=\sqrt{2\mu/\rho_m \omega}$, where $\mu$ is the viscosity of the fluid. In the prior art stack geometries shown in FIGS. 1A, 1B, and 1C, the working fluid is presented with essentially a flat or concave stack surface. The thermoacoustic volume is then approximately a rectangular volume $\delta_K A$, and the viscous volume would be approximately $\delta_v A$, where A is the exposed surface area of the stack. Thus, the ratio of the desirable to undesirable volumes is approximately the ratio of the thermal to viscous penetration depths. Since the thermal penetration depth is typically only 1.2–1.6 times the viscous penetration depth, a sizable fraction of the fluid is undergoing viscous energy loss. This leads to lower engine efficiencies and to additional problems in removing waste heat.

Thermal conduction in the solid stack material along the acoustic wave vector direction is an additional disadvantage of prior art stack geometries. It is clear that such heat flow decreases the useful output of the thermoacoustic device, and that the heat flow is proportional to the amount of cross-sectional area, taken across the acoustic axis, that is made up of solid material. In prior art geometries, the fraction of cross-sectional area taken up by the solid portion is high, limiting the choice of stack materials to those of low thermal conductivity.

These and other problems of the prior art are addressed by the present invention and an improved stack design is presented. Accordingly, it is an object of the present invention to reduce viscous losses in the thermoacoustic stack.

It is another object of the present invention to minimize the thermal conductivity of the stack along the acoustic axis.

Yet another object of the present invention is to increase the ratio of the volume of fluid at about a thermal penetration depth to the volume of fluid within a viscous penetration depth.

Yet another object of the present invention is to increase the ratio of the volume of fluid at about a thermal penetration depth to the volume of fluid within a viscous penetration depth.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a thermoacoustic stack for connecting two heat exchangers in a thermoacoustic energy converter, where the stack defines substantially convex fluid-solid interfaces in planes perpendicular to an axis for acoustic oscillation within the stack. In different embodiments, the convex interfaces may be formed from a variety of elongated structures, including wires, fibers, thin rods or pins, ribbons, an etched array, and the like.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

A variety of thermoacoustic energy converters are described in U.S. Pat. Nos. 4,398,398, 4,489,553, and 4,722,201, incorporated herein by reference, and in Wheatley, supra, and Swift, Supra. At the heart of all of these converters is a thermoacoustic stack. In accordance with our invention, the stack is formed from a plurality of elements having generally convex cross sections in a plane perpendicular to the axis along which the acoustic medium oscillates in order to increase the ratio of the volume of fluid at about a thermal penetration depth $\delta_K$ to the volume of fluid within a viscous penetration depth $\delta_\nu$. Substantial energy loss occurs from viscous losses in the fluid volume near the surface. A convex surface acts to greatly reduce this volume relative to the fluid volume within which thermal energy is being transferred. Thus, the ratio of the volume for energy transfer to the volume for viscous losses is increased and the ratio of useful energy transfer to viscous energy loss is increased.

Figure 1A:
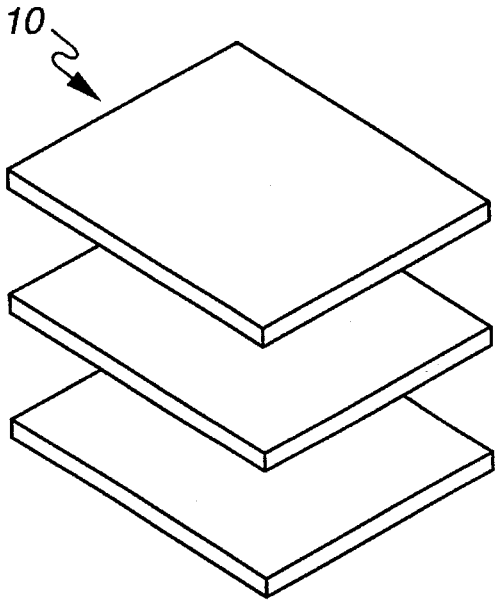
Fig. 1A (Prior Art)
FIGS. 1A, 1B, and 1C are pictorial illustrations of various prior art stack designs.
Figure 1B:
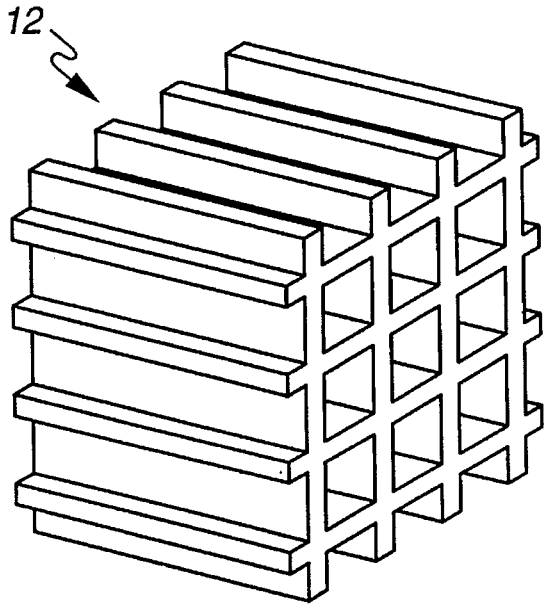
Fig. 1B (Prior Art)
Figure 1C:
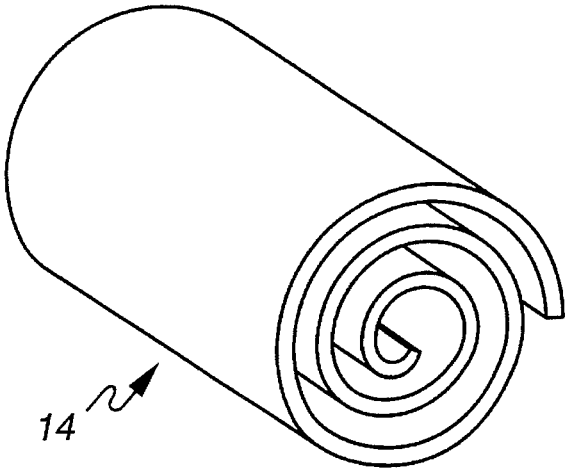
Fig. 1C (Prior Art)
Figure 2A:
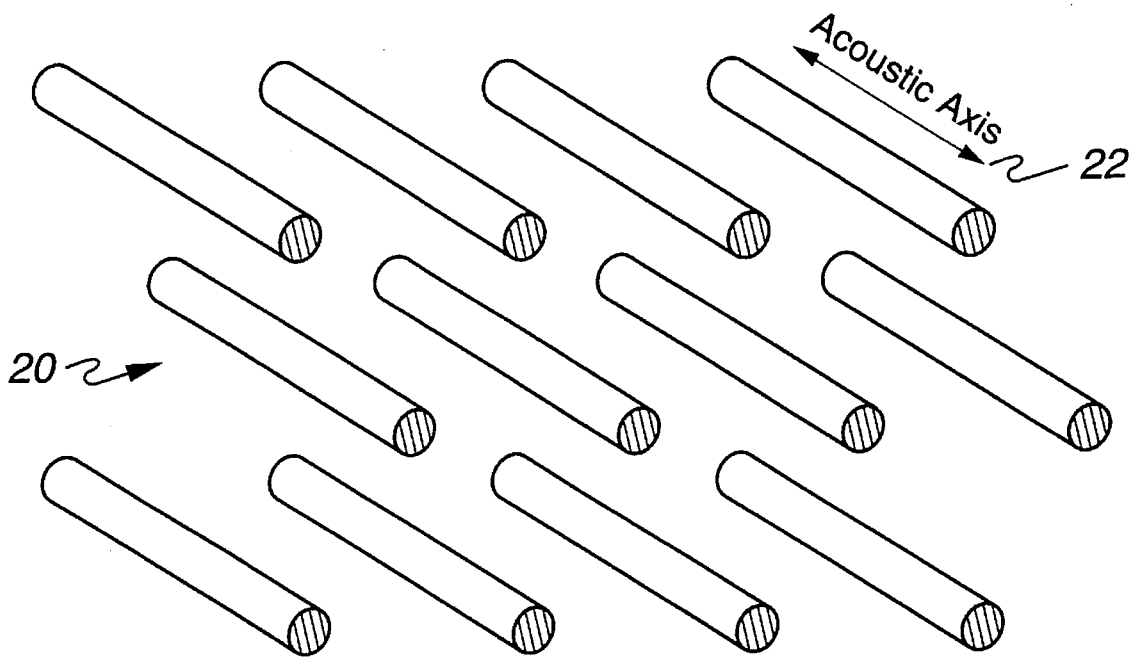
FIGS. 2A and 2B are a pictorial illustration and associated cross-section of one embodiment of a stack array according to the present invention.
Figure 2B:
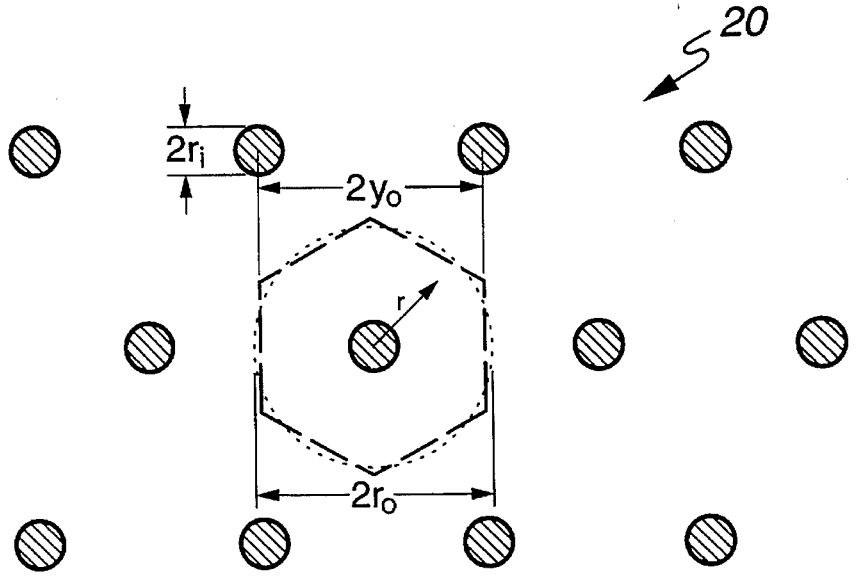

An exemplary pin array 20 is shown in FIGS. 2A and 2B, with the pins axially aligned in parallel with the acoustic axis 22, i.e., along the direction of the acoustic wave oscillations. In the limit of very small pins (pin radius $<<\delta_\nu$), the ratio of the volumes varies as $(\delta_K/\delta_\nu)^2$ in our invention rather than $(\delta_K/\delta_\nu)$ as in the prior art. Typical volume ratios are improved with engine efficiency improvement of up to about 15%.

Referring now to FIG. 2B, there is seen a pin array 20 geometry with a hexagonal array of pins with radius $r_i$ and spacing $2y_O$ where the axes of the pins are aligned with the acoustic wave. The linearized equation of motion $$i\omega\rho_m u_1 = -dp_1/dx + \mu\nabla^2 u_1 \tag{1}$$

must be solved for complex gas velocity amplitude $u_1$, where $p_1$ is complex pressure amplitude, $\omega$ is angular frequency, $\rho_m$ is mean gas density, $\mu$ is gas viscosity, x is the coordinate in the direction of the acoustic wave-vector (along which the pins are aligned), and $\nabla^2$ operates perpendicular to x. Equation (1) must be solved subject to a no-slip boundary condition $$u_1(r_1)=0 \tag{2}$$

at the surface of the pin, and a symmetry boundary condition $$\nabla_\perp u_1(\text{hexagon})=0 \tag{3}$$

at the hexagonal boundary of the unit cell shown in FIG. 2B, where $\nabla\perp$ is the derivative in the direction perpendicular to the hexagonal unit cell boundary. Assuming that the hexagonal unit cell can be treated as a circle of equal area, the symmetry boundary condition simplifies to $$\partial u_1(r_o)/\partial r=0 \tag{4}$$

where the circle radius $r_o$ is related to array half-spacing $y_o$ by $r_o=\sqrt{\sqrt{(2\sqrt{3}/\pi)}}y_o \cong 1.05y_o$. This approximation is exact only in the limit $r_o/\delta_\nu \to \infty$(where $\delta_\nu=\sqrt{2\mu/\omega\rho_m}$ is the viscous penetration depth), where essentially all of the spatial variation in $u_1$ occurs within a few $\delta_\nu$ of the pins, so $\nabla u_1 \to 0$ everywhere near the unit cell boundary. This approximation is believed to be reasonably accurate for two reasons. (1) The boundary condition at $r_o$ is much less important than that at $r_i$ in determining $u_1$ because $u_1$ varies with position much more strongly near $r_i$ (at the no-slip boundary) than near $r_o$. (2) The details of pore shape have not been critical in two previously investigated cases: W. P. Arnott, et al., "General Formulation of Thermoacoustics for Stacks Having Arbitrarily Shaped Pore Cross Sections," 90 J. Acoust. Sec. Am. 3228 (1991) shows this analytically for stacks having arbitrarily shaped pore cross sections; and G. W. Swift, "Analysis and Performance of a Large Thermoacoustic Engine," 92 J. Acoust. Sec. Am. 1551 (1992) shows this experimentally for hexagonal pores approximated as circles.

The solution to Eq. (1), subject to the boundary conditions given by Eqs. (2) and (4), contains Bessel functions J and Neumann functions Y:

$$u_1 = \frac{1}{i\omega\rho_m}\frac{dp_1}{dx}\left[1-\frac{Y_1(z_o)J_0(z)-J_1(z_o)Y_0(z)}{Y_1(z_o)J_0(z_i)-J_1(z_o)Y_0(z_i)}\right] \tag{5}$$

where $z=\sqrt{\sqrt{-i\omega\rho_m/\mu}}r=(i-1)r/\delta_\nu$. The spatial average velocity $<u_1>$ defines the thermoviscous function $f_\nu$ (N. Reit, "Damped and Thermally Driven Acoustic Oscillations in Wide and Narrow Tubes," 20 Z. Angew. Math. Phys. 230 (1969)):

$$<u_1> = \frac{1}{i\omega\rho_m}\frac{dp_1}{dx}(1-f_\nu). \tag{6}$$

Integrating Eq. (5)

$$f_\nu = \frac{2z_i}{z_o^2-z_i^2}\frac{Y_1(z_o)J_1(z_i)-J_1(z_o)Y_1(z_i)}{Y_1(z_o)J_o(z_i)-J_1(z_o)Y_0(z_i)}. \tag{7}$$

Figure 3:
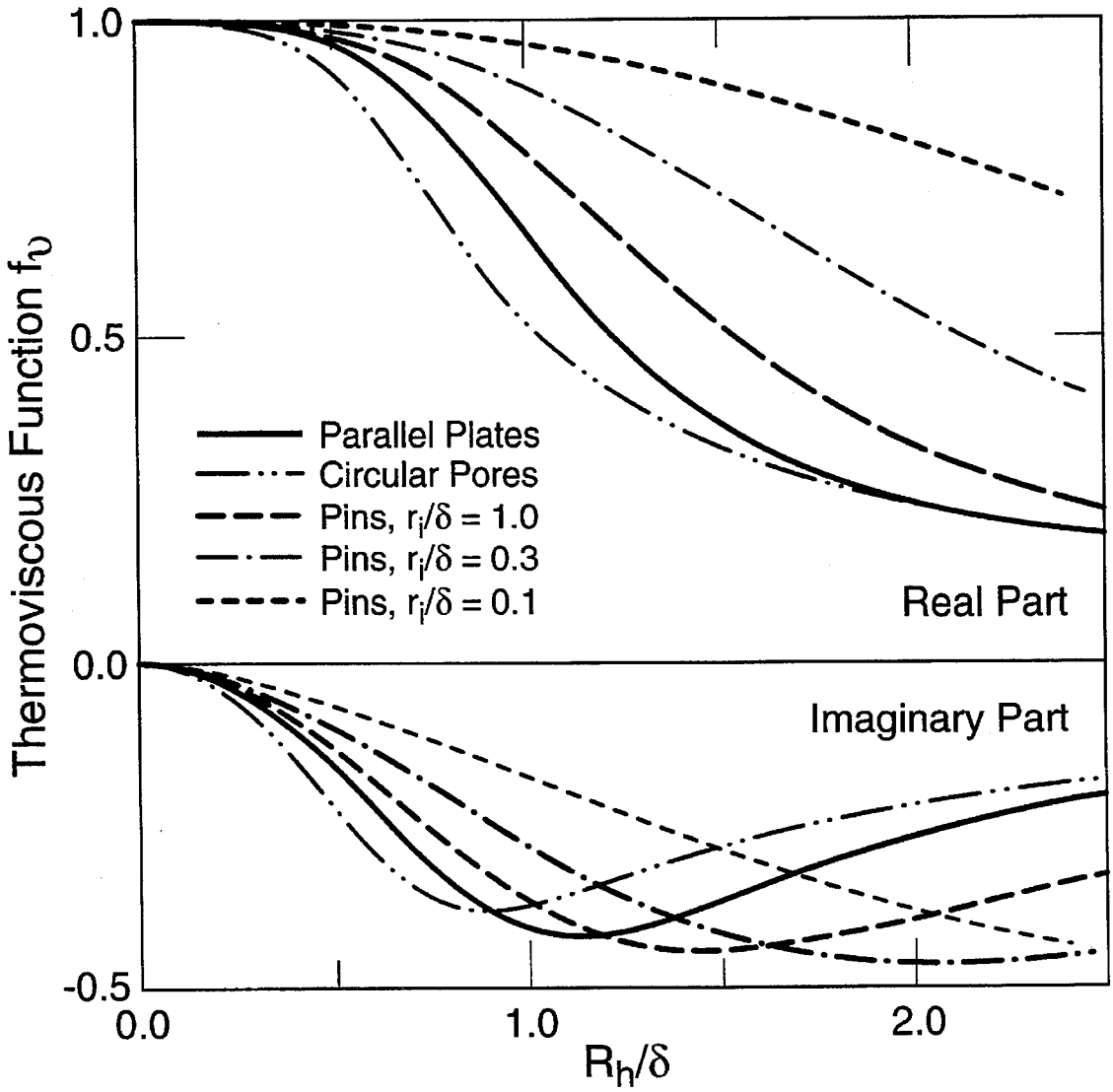
FIG. 3 graphically depicts values for the thermoviscous function as a function of pore size, for pin-array with three values of inner radius, and for parallel-plate and circular pores.

The thermoviscous function is depicted in FIG. 3, along with the corresponding functions for parallel-plate and circular-pore geometries. The hydraulic radius, $R_h$, normalized to $R_h/\delta_\nu$ is used as an independent variable, with $R_h$ equal to the ratio of gas area to solid perimeter: $R_h=(r_o^2-r_i^2)/2r_i$ for the pin stack; $R_h=r_o/2$ for circular pores of radius $r_o$; and $R_h$ equals the plate half-spacing for parallel plates.

Arnott et al., supra, assumed that the solid material of the stack had sufficient heat capacity to keep the solid-gas interface isothermal. Then, the differential equation for oscillating temperature $T_1$ in the gas is similar to Equation (1) so that the solution for $T_1$ is easily constructed from the solution for $u_1$, and all other thermoacoustic results depend on stack geometry only through the functions $f_\nu$ and $f_k$, where $f_k$ is obtained from $f_\nu$ by replacing $\mu$ with $K/c_p$, or equivalently, replacing $\delta_\nu$ with $\delta_K=\sqrt{\sqrt{2K/\rho_m c_p}}$, where K is the gas's thermal conductivity and $c_p$ is its isobaric heat capacity per unit mass.

Arnott et al., supra, also noted that thermoacoustic heat transport and work are proportional to $\mathrm{Im}[f_K]$ in the standing-wave, inviscid limit, and that acoustic power dissipated by viscosity is proportional to $\mathrm{IM}[f_\nu]/|1-f_\nu|^2$ when $dT_m dx=0$. Thus, the ratio $$M\sqrt{\sqrt{\sigma}}Im[f_K]|1-f_\nu|^2/Im[f_\nu] \tag{8}$$

is used as a tentative figure of merit for comparison of different stack geometries. The factor $\sqrt{\sqrt{\sigma}}$ (where $\sigma=\mu c_p/K$ is the gas Prandtl number) is included in M so that when $R_h \to \infty$ for circular pores and parallel plates, $M \to 1$ independent of $\sigma$.

Figure 4:
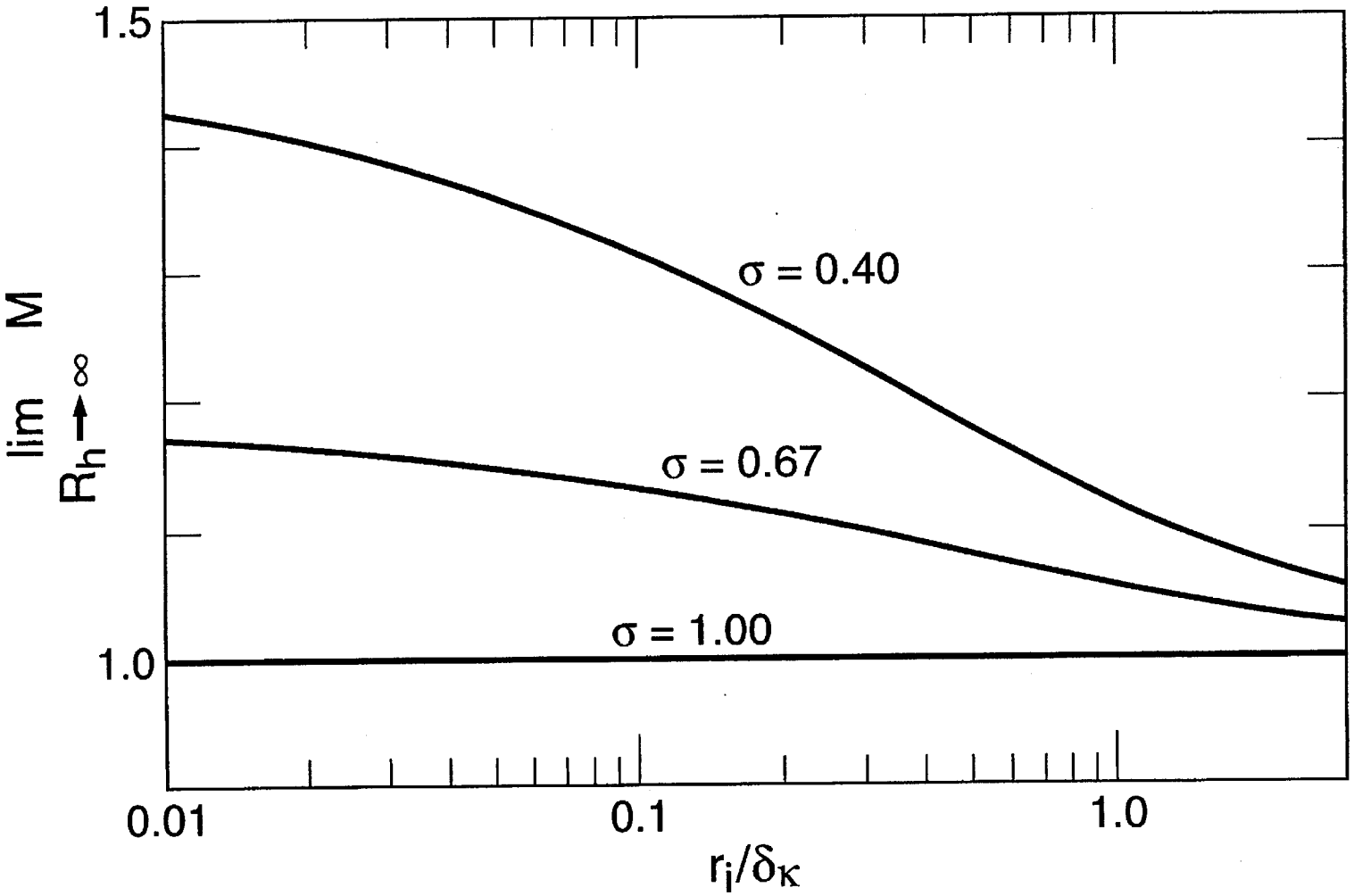
FIG. 4 graphically depicts a figure of merit M giving the ratio of inviscid thermoacoustic heat transport to viscous power dissipation, as a function of pin size in the large pore size limit, with results for three Prandtl numbers $\sigma$ to show the superior performance of small radius pins over parallel plates or circular pores, for which M=1 for all $\sigma$ in the large pore size limit.

FIG. 4 shows lira M for the pin stack for three different Prandtl $R_h \to \infty$ numbers $\sigma$: $\sigma=1$; $\sigma=2/3$, characteristic of pure monatomic gases; and $\sigma=0.4$, characteristic of 5% xenon in helium or 30% argon in helium. This figure of merit shows that the pin stack is significantly superior to other stack geometries for $r_1<\delta_K$ and for Prandtl numbers typical of gases.

Figure 5A:
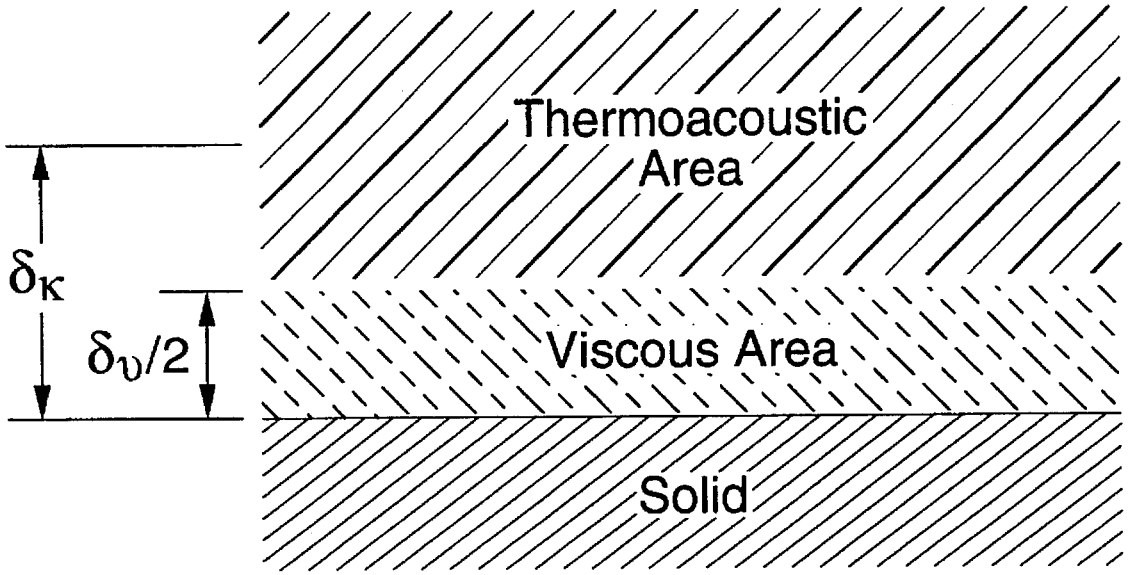
Fig. 5A (Prior Art)
FIGS. 5A and 5B illustrate the geometric differences between a pin stack and a parallel-plate stack with the fluid velocity directed into the plane of the figure.
Figure 5B:
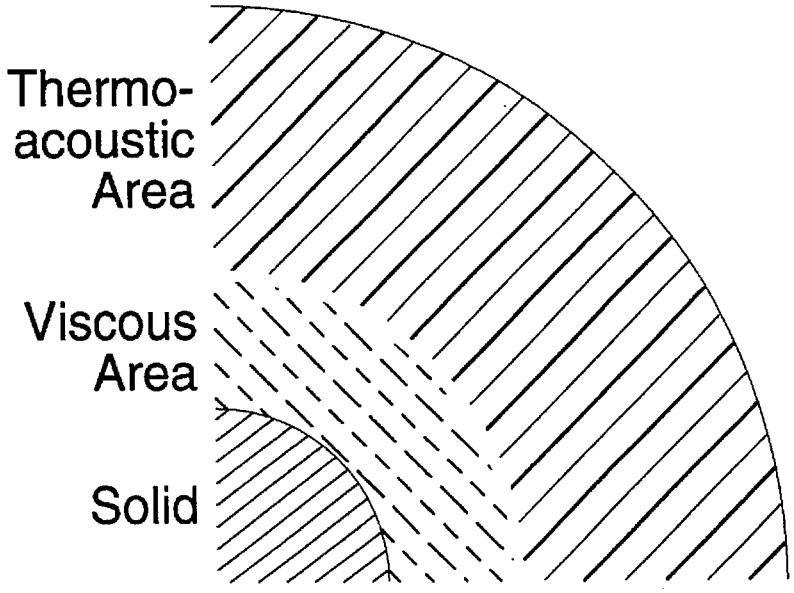

A heuristic model of the differences between a pin stack array and a plane array is shown in FIGS. 5A and 5B. The fluid velocity $u_1$ is directed into the plane of the paper. Viscous dissipation occurs adjacent the solid surface, while thermoacoustic effects occur mostly at about a thermal penetration depth $\delta_K$ away from the surface. The convexity of the surface shown in FIG. 5B illustrates that the pin stack array has a greater ratio of thermoacoustic area to viscous area than for the planar surface shown in FIG. 5A. For the planar surface and in the boundary layer approximation, the inviscid heat flow density and work density in the inviscid limit are proportional to $IM\{T_1\} \propto IM\{-e^{-(1+i)y/\delta_K}\}$, which is zero at the gas-solid boundary and has its maximum at a distance $y \cong \delta_K$ from the boundary. Acoustic power dissipation per unit volume due to viscosity, on the other hand, is proportional to $\{\nabla u_1|^2 \propto e^{-2y/\delta_\nu}$, which has its maximum at y=0 and decreases rapidly with y. Thus, productive and dissipative processes mostly occur at different distances from the surfaces, and the present invention recognizes that changing the curvature of the surface changes the ratio of productive to dissipative effects.

In order to analyze the efficiency improvements provided by a pin stack array, it is necessary to allow nonzero oscillating temperature at the solid-gas boundary. This effect is important for pin stacks because the thermal and viscous effects drive the design toward an ever smaller $r_i$, where the pin heat capacity becomes too small to maintain the gas-solid interface isothermal. The stack solid heat-capacity factor $\epsilon_S$, as used in Swift (1988), supra, for the pin stack array shown in FIG. 2B is given by $$\epsilon_s = \left[\frac{K\rho c_p}{K_s \rho_s c_s}\right]^{1/2} \frac{J_0(\sqrt{-i\omega/\kappa_s}\ r_i)}{J_1(\sqrt{-i\omega/\kappa_s}\ r_i)} f_\kappa \sqrt{-i\omega/\kappa}\ \frac{r_o^2 - r_i^2}{2r_i}, \quad (9)$$

where the subscript s refers to solid properties and the diffusivity $K=K/\rho c_p$.

Equations (7) and (9) were used to calculate the parameters $f_\nu$, $f_K$, and $\epsilon_S$ and the parameters used to calculate pin stack efficiencies in three thermoacoustic systems of interest. The selected pin stack dimensions were pins having diameters of typically 100 μm, with spacings of typically 0.5–1.0 mm. The first system was a thermoacoustic engine intended as a combustion-powered driver for a natural-gas liquefier. The system will operate at 35 Hz using 3.5 MPa helium gas. The pin stack array provided a calculated improvement in system efficiency over a parallel plate design of 15%, where efficiency is defined to be acoustic power delivered to the liquefier divided by heat supplied at the hot heat exchanger. The second case was a heat-driven heat pump, comprising a thermoacoustic engine driving a thermoacoustic heat pump, using 2 MPa helium at 100 Hz. Use of a pin stack array in the engine improved its calculated efficiency by 10%, while use of a pin stack array in the heat pump improved its efficiency by 9%. The third case was a loudspeaker-driven thermoacoustic refrigerator using 12% xenon in helium at 2 MPa and 240 Hz. In this configuration, a pin stack array improved the calculated efficiency only about 2%.

Figure 6:
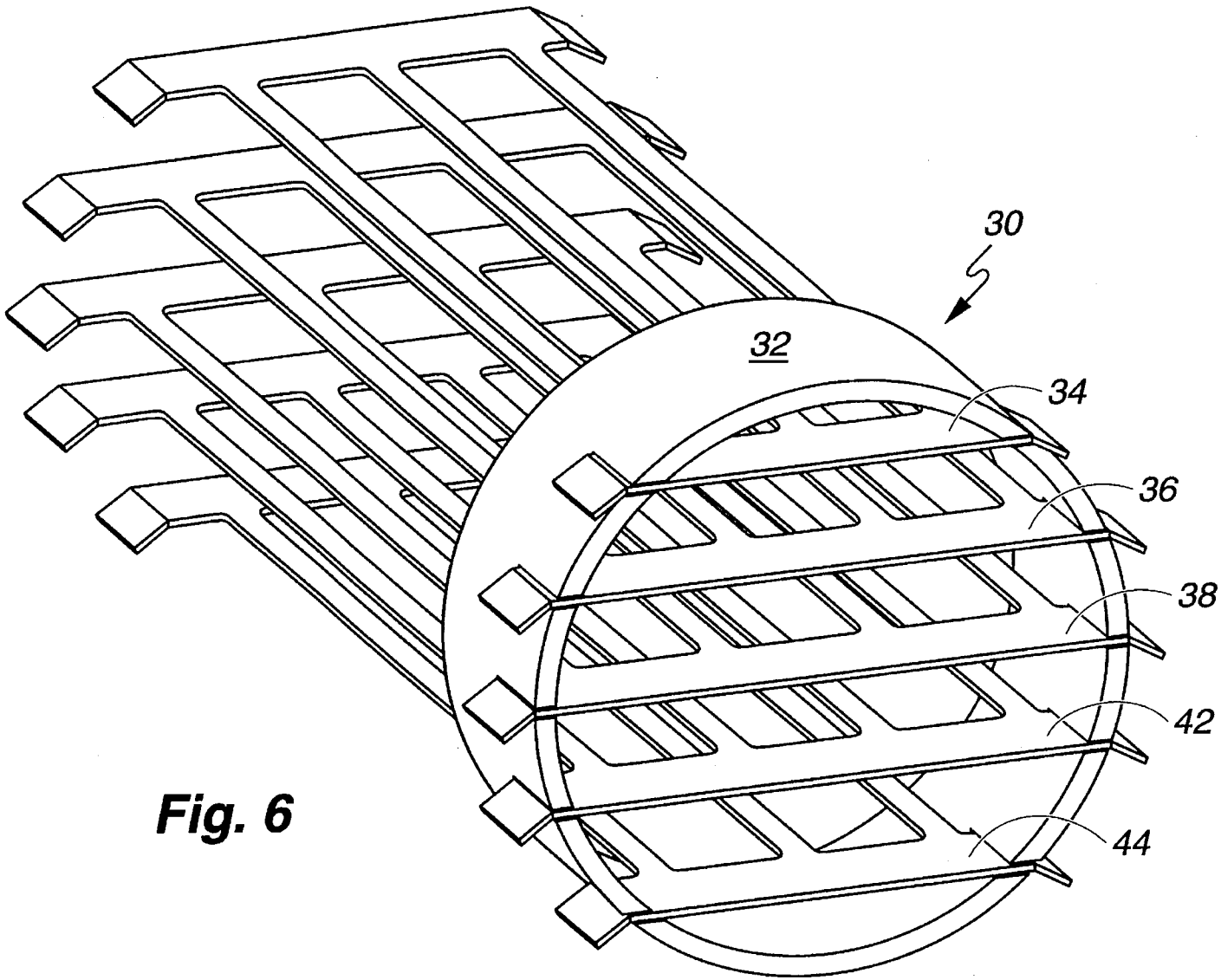
FIG. 6 is a isometric view of one embodiment of the present invention.
Figure 7:
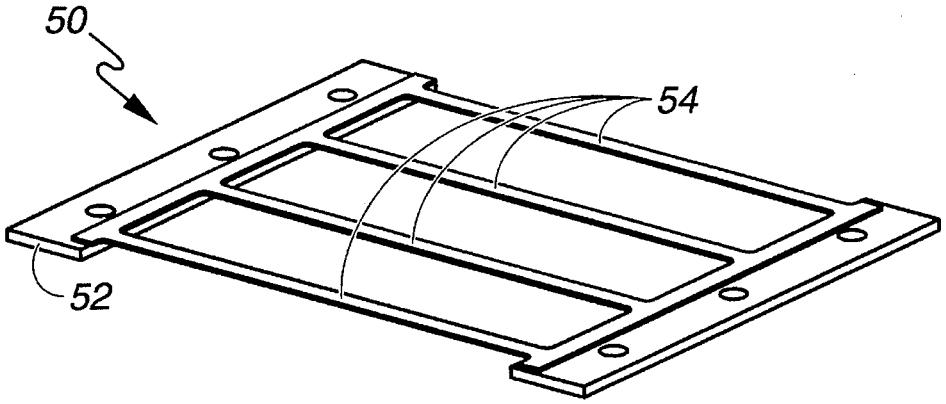
FIG. 7 is an isometric view of one element of an array according to the present invention.
Figure 8:
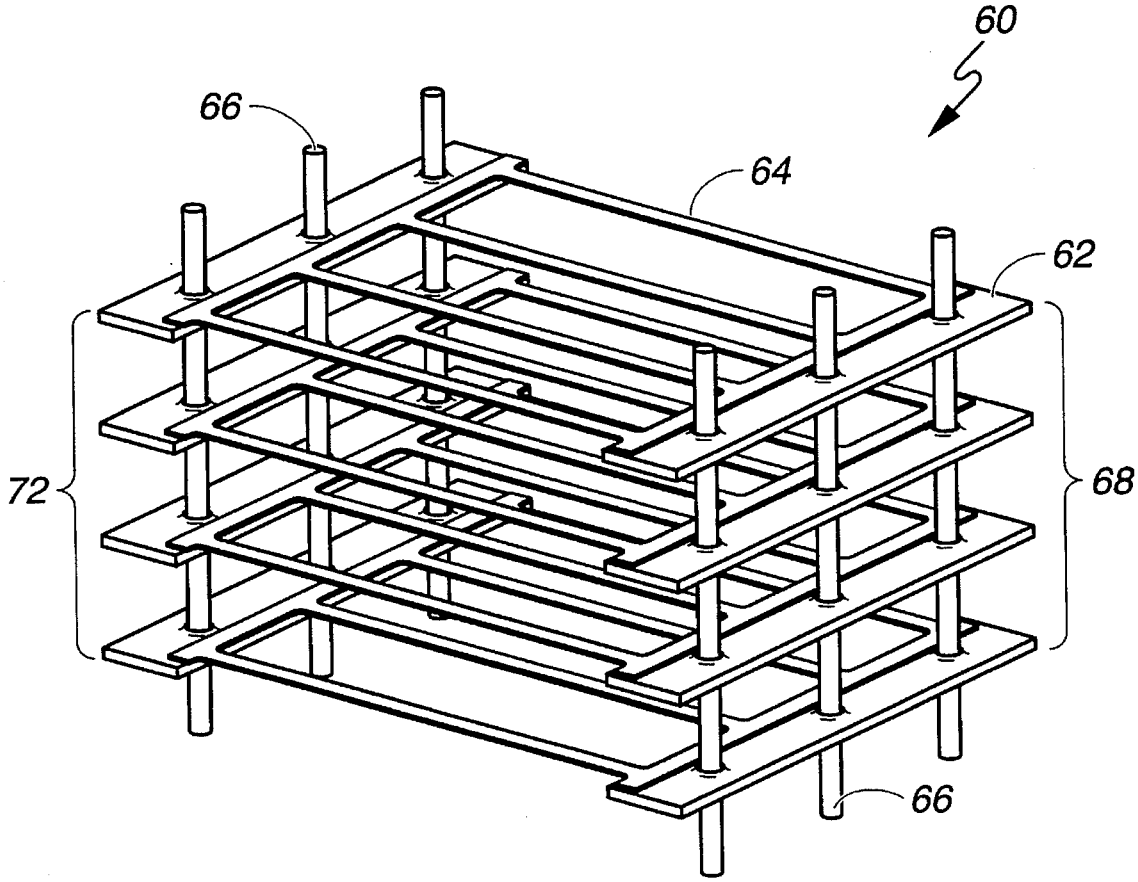
FIG. 8 is an isometric view of a second embodiment of the present invention using elements shown in FIG. 7.

Several possible "pin" stack array designs are shown in FIGS. 6, 7, and 8. The most important characteristic of a pin stack is the convexity of the gas-solid interface, on a scale comparable to the viscous and thermal penetration depths. The optimum pin diameters are so much smaller than the penetration depths that the exact shape of the pin cross-section is believed to be unimportant. Likewise, the details of the boundary condition at the array-unit-cell boundary are believed to be unimportant, so that perfect uniformity of the array geometry will not be needed to achieve the advantages of the invention. Thus, an effective radius can be defined simply as $r_{i,effective}=\sqrt{A/\pi}$ Several embodiments of a pin stack according to the present invention are shown in FIGS. 6, 7, and 8. FIG. 6 shows an embodiment of a pin stack array 30 with the pin elements formed by chemically etching or stamping sheets of a material such as stainless steel or plastic with low or moderate thermal conductivity. By way of example, for a fluid medium of pressurized monaromic gases, thin sheets of material, e.g., 100 μm thick, have material removed to provide rows of pin-like elements spaced about a millimeter apart. As shown in FIG. 6, the stamped sheets 34, 36, 36, 42, and 44 are placed through a tube 32 at each end of the sheets (only one end is shown in FIG. 6), which may be a heat exchanger, and secured within the heat exchanger by tabs extending from the stamped sheets. The pin-like elements may be aligned to form the desired hexagonal array of pins.

In one alternative, shown in FIG. 7, pin array elements 50 are formed by forming pin-like elements 54 in a low conductivity sheet material that is bonded to a high thermal conductivity material 52 on the ends. The high conductivity ends can then serve as heat exchanger fins in an assembled thermoacoustic array.

In yet another embodiment shown in FIG. 8, a pin stack array 60 is formed from wire elements 64 bonded to high thermal conductivity ends 62. High conductivity ends 62 have holes stamped in them for accepting heat exchanger tubes 66 to form end heat exchangers 68 and 72. It will be understood that the pin stack arrays and elements shown in FIGS. 6, 7, and 8 may require periodic structural elements, such as spacers, to keep the pins from vibrating or sagging in the operating arrays.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A thermoacoustic stack for connecting two heat exchangers in a thermoacoustic energy converter having an oscillating fluid medium, the improvement comprising:

an array of generally parallel elements, each element having an effective radius that defines a generally convex fluid-solid interface in a plane perpendicular to an axis for acoustic oscillation of said fluid between said heat exchangers, said effective radius having a value less than a viscous penetration depth of said fluid and increasing the ratio of thermoacoustic area to viscous area in said medium.

2. A thermoacoustic array according to claim 1, wherein said parallel elements form a hexagonal pattern in said plane perpendicular to said axis for acoustic oscillation.

3. A thermoacoustic array according to claim 1, wherein said parallel elements form a square pattern in said plane perpendicular to said axis for acoustic oscillation.

4. A thermoacoustic array according to claim 1, wherein each said element has a substantially circular cross-section in said plane perpendicular to said axis for acoustic oscillation.

* * * * *